United States Patent [19]

Wilson

[11] Patent Number: 5,059,279

[45] **Date of Patent: * Oct. 22, 1991**

[54] SUSCEPTOR FOR MICROWAVE HEATING

[75] Inventor: David Wilson, Mississauga, Canada

[73] Assignee: Golden Valley Microwave Foods Inc., Edina, Minn.

[ * ] Notice: The portion of the term of this patent subsequent to Sep. 25, 2007 has been disclaimed.

[21] Appl. No.: 529,229

[22] Filed: May 25, 1990

Related U.S. Application Data

[63] Continuation of Ser. No. 369,193, Jun. 21, 1989, Pat. No. 4,959,120.

[51] Int. Cl.[5] ..... B44C 1/22; C23F 1/02

[52] U.S. Cl. ..... 156/651; 156/634; 156/659.1; 219/10.55 E; 383/116; 428/209

[58] Field of Search ..... 156/629, 630, 633, 634, 156/651, 656, 659.1, 661.1, 664, 665; 428/195, 209; 219/10.43, 10.55 E, 10.55 M, 10.55 R; 383/116

[56] References Cited

U.S. PATENT DOCUMENTS

| | | | |
|---|---|---|---|
| 3,647,508 | 3/1972 | Gorell | 117/38 |
| 4,230,924 | 10/1980 | Brastad | 219/10.55 E |
| 4,258,086 | 3/1981 | Beall | 219/10.43 |
| 4,267,420 | 5/1981 | Brastad | 219/10.55 E |
| 4,398,994 | 8/1983 | Beckett | 156/659.1 |
| 4,517,045 | 5/1985 | Beckett | 156/345 |
| 4,552,614 | 11/1985 | Beckett | 156/640 |
| 4,610,755 | 9/1986 | Beckett | 156/634 |
| 4,641,005 | 2/1987 | Seiferth | 219/10.55 E |
| 4,678,882 | 7/1987 | Bohrer | 219/10.55 E |
| 4,685,997 | 8/1987 | Beckett | 156/629 |
| 4,735,513 | 4/1988 | Watkins et al. | 383/116 |
| 4,878,765 | 11/1989 | Watkins et al. | 219/10.55 E |
| 4,883,936 | 11/1989 | Maynard et al. | 219/10.55 F |
| 4,959,120 | 9/1990 | Wilson | 156/651 |

FOREIGN PATENT DOCUMENTS

| | | |
|---|---|---|
| 0205304 | 12/1986 | European Pat. Off. . |
| 0282015 | 9/1988 | European Pat. Off. . |

*Primary Examiner*—William A. Powell
*Attorney, Agent, or Firm*—James V. Harmon

[57] ABSTRACT

A selectively demetallized metal film is provided in which the metal film has different amounts of metal removed in different areas to provide a film having a graduated optical density from one area to another. The amount of metal present in the film can vary gradually and continuously or in stages resulting in a series of bands or patches. Each portion of the film appears uniform, homogeneous and uninterrupted to the unaided eye. The product is produced by providing a substrate such as plastic film having a thin semiconductive metal film coated thereon. Different amounts of the metal are removed from the film in different areas, preferably by exposing the metal film in different areas to different amounts of an etchant which can be provided in the form of minute droplets of one size in one area and of a different size in a different area. The etchant can be applied by halftone printing as variably sized dots on uniformly fixed centers with larger dots of etchant applied in some areas than in others to remove a greater amount of the metal.

40 Claims, 3 Drawing Sheets

SUSCEPTOR FOR MICROWAVE HEATING

This is a continuation of application Ser. No. 07/369,193, filed June 21, 1989, now U.S. Pat. No. 4,959,120.

FIELD OF THE INVENTION

The present invention relates to the demetallization of metal films and to the provision of a microwave susceptor in which different portions produce different amounts of heat.

BACKGROUND OF THE INVENTION

It is known to use a thin film of metal deposited on a flexible substrate such as a plastic sheet by vacuum electrodeposition for the purpose of heating foods in a microwave oven. Heaters of this kind which are known as susceptors provide a more intense heating effect at the surface of the food. The film of metal is thin enough to be electrically semiconductive so that during the heating process an electric current induced into the metal film from the electromagnetic field of the microwave oven produces duces $I^2R$ losses which heat the food. The heating of food products by means of semiconductive vacuum electro-deposited metal films is exemplified by U.S. Pat. Nos. 4,230,924; 4,268,420; 4,258,086; 4,735,513; 4,641,005 and 4,678,882, and European patent application 0 205 304. In order to produce patches, i.e. rectangular metallized areas, the parts of the metallized film surrounding the patch are removed, i.e. totally demetallized, for example by the application of a caustic solution to the area that is to be removed. The dissolved metal is then washed off.

The demetallization of a metallized film is described for example in European application 0 205 304 and U.S. Pat. Nos. 3,647,508; 4,398,994; 4,522,614; and 4,735,513. The metal film is removed either by applying a caustic solution directly to the metal film or by covering portions of the metal film with a protective varnish and thereafter exposing the entire surface to caustic which dissolves the metal exposed beyond the edges of the varnish layer.

In the method described in U.S. Pat. No. 4,258,086, metal is removed by minute currents which pass between electrically conductive metal foil squares held adjacent to the coated film that is being treated. Using these methods, Beall and Brastad prepared demetallized films that have visible rectangular metallized patches or islands as small as 1/32nd inch on a side. These sheets are entirely covered with uniformly spaced visible rectangles. As a result, the heat produced by the sheet in a microwave oven is uniform throughout the entire sheet.

It is a primary object of the present invention to provide an improved method of partially demetallizing metal films so as to provide a metal film with gradations in optical density. Another object is to provide a semi conductive metallized film which is capable of producing differential heating, i.e. different amounts of heat in different areas thereof when exposed to microwave energy in a microwave oven. Yet another object is to provide a metallized sheet which is partially demetallized and wherein the degree of demetallization can be precisely controlled to thereby vary the optical density of the coating from one portion thereof to another for decorative or heating applications. A further object is to provide a demetallized metal film of the type described wherein the partially demetallized portions appear uniform, homogeneous and uninterrupted to the naked eye. Another object is to provide a unique microwave susceptor having a heating patch or target adapted to provide 'focused' heating so as to produce a higher temperature near the center and a lower temperature at the periphery. Still another object is to provide a partially demetallized, semiconductive metal susceptor for microwave heating which is economical to produce, practical to manufacture, wherein the heat produced in different areas can be precisely controlled, and the various areas producing different amounts of heat can be given any desired shape.

SUMMARY OF THE INVENTION

The invention provides a nonconductive backing formed from sheet material with an electrically semiconductive metal film thereon having a selected resistivity and optical density in one portion thereof and a different resistivity and optical density in another portion. The backing can comprise sheet material such as paper or a flexible plastic film. The product thus has different regions with gradations in resistivity and optical density. As a result, the different areas of the film will absorb or reflect different amounts of light to produce unique visual effects for decorative purposes as well as producing different amounts of heat when exposed to microwave energy in a microwave oven.

The amount of metal present in the film can vary gradually and continuously or in stages resulting in a series of bands or patches. The terms "graduated" and "gradations" herein are used broadly to encompass both forms. The resulting semiconductive coated products are supple, flexible and can be made with numerous areas, each of any desired shape and each area adapted to produce a different amount of heat. Moreover, the various differentially metallized areas appear uniform, homogeneous and uninterrupted to the unaided eye. Several metal coated areas can be made to appear as various shades of grey or, under some conditions, reflective of light to different degrees.

In accordance with one preferred process used for producing the present invention, a nonconductive substrate or base such as plastic film having a thin, preferably uniform, metal film thereon is provided as the starting material. The metal film has electrical characteristics which produce heat when the susceptor is placed in a microwave oven. In accordance with the present invention, different amounts of metal are removed from the initially uniform metal film in different areas or regions thereof to provide differences in the resistivity and the optical density of the metal film from one area to another. As a result, different regions of the metal film produce different amounts of heat when exposed to microwave energy in a microwave oven.

In one preferred process, the metal film is partially removed by exposing different regions of the metal film to different amounts of an etchant. The etchant can be provided in the form of minute droplets of one size in one area and of a different size in a different area of the metal film. This treatment removes more metal in one area than in another. The metal can be removed in accordance with the invention by halftone printing of an etchant or a mask for an etchant onto the metal film. The etchant is applied as variably sized dots on uniform fixed centers, with larger dots of the etchant applied in some areas than in others, thereby removing more metal in some areas than in others.

The invention will be better understood by reference to the following illustrative embodiments which set forth by way of example some of the various forms of the invention within the scope of the appended claims.

THE FIGURES

DETAILED DESCRIPTION

Figure 1:
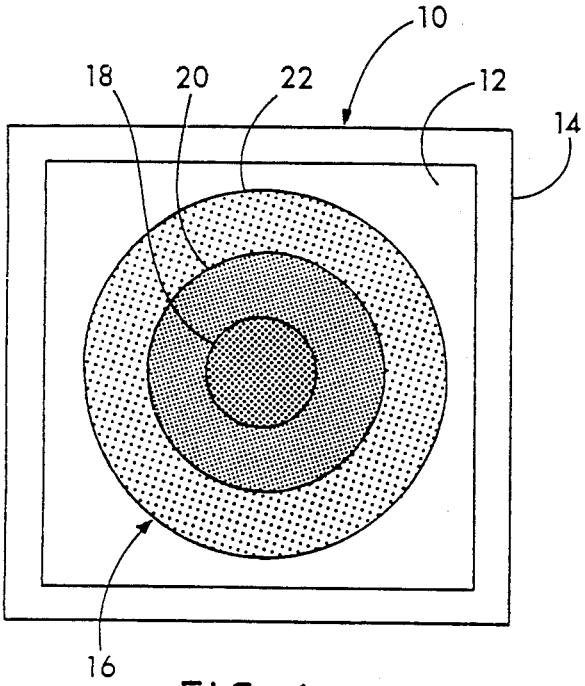
FIG. 1 is a plan view of a susceptor for microwave heating in accordance with the invention.
Figure 2:
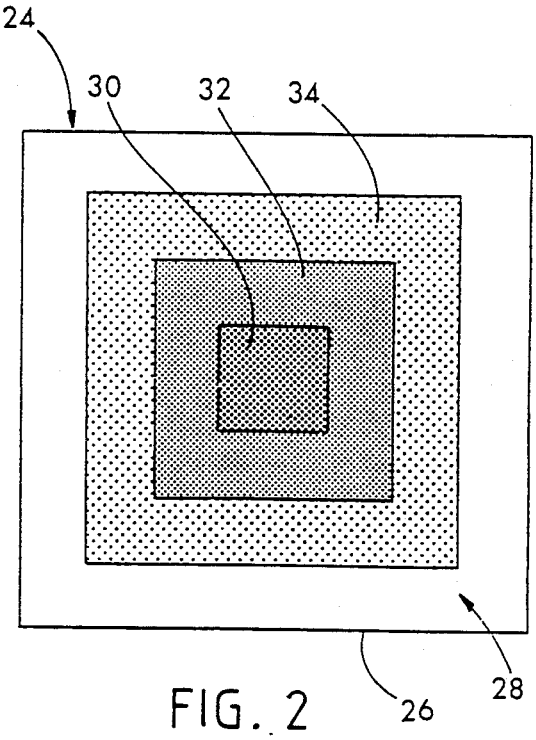
FIG. 2 is a view of another susceptor similar to FIG. 1.

Refer to FIGS. 1 and 2 which illustrate typical products in accordance with the present invention. The products of FIGS. 1 and 2 similar except that the pattern of FIG. 1 is circular while FIG. 2 illustrates a square pattern. Both forms illustrate the use of the invention as a susceptor for heating products such as food in a microwave oven by absorbing microwave energy and converting the energy into heat which is transferred to the food by conduction.

In FIG. 1 the susceptor 10 includes a backing 12 formed from flexible sheet material, in this case a plastic film such as one-half mil polyester (Mylar®) film, bonded with adhesive, e.g. a polyvinyl acetate emulsion adhesive, to a support sheet 14 such as food grade paperboard. The film 12 has applied to it a semiconductive metal coating 16. The metal coating 16 is preferably applied by vapor deposition under vacuum. Initially the coating 16 uniformly covers the entire surface of the backing film 12. Portions, however, of the metal film 16 are removed as will be described to provide a center area 18, an inner ring 20 and an outer ring 22. Little, if any, of the metal is removed from the center area 18, while progressively greater amounts of metal are removed from the rings 20 and 22. Each of the areas 18–22 appear uniform, homogeneous and uninterrupted to the unaided eye. The area 18 appears medium to dark grey and slightly reflective. The ring 20 appears to be a medium grey and ring 22 appears to be light grey. The susceptor indicated generally at 24 in FIG. 2 includes a backing 26 such as flexible plastic film, upon which the metallized coating indicated generally at 28 is applied, that is bonded to a paper or paperboard supporting sheet. Similarly, in the case of FIG. 2 the central area 30 appears darkest, the first ring 32 appears to be a somewhat lighter shade of uniform grey and the outermost ring 34 appears as a light grey uniform ring. All three areas are homogeneous, uniform and uninterrupted.

A variety of metals can be used including but not limited to aluminum, copper, nickel, zinc, gold, silver, tin and stainless steel. The backing 12 can be a suitable plastic including polyester (Mylar®), polyetherimide (Danar®; Dixon Industries; Bristol, RI) or smooth paper and, for products which are not heated, polyethylene, polypropylene, cellophane, saran, cellulose, acetate and the like.

Figure 8:
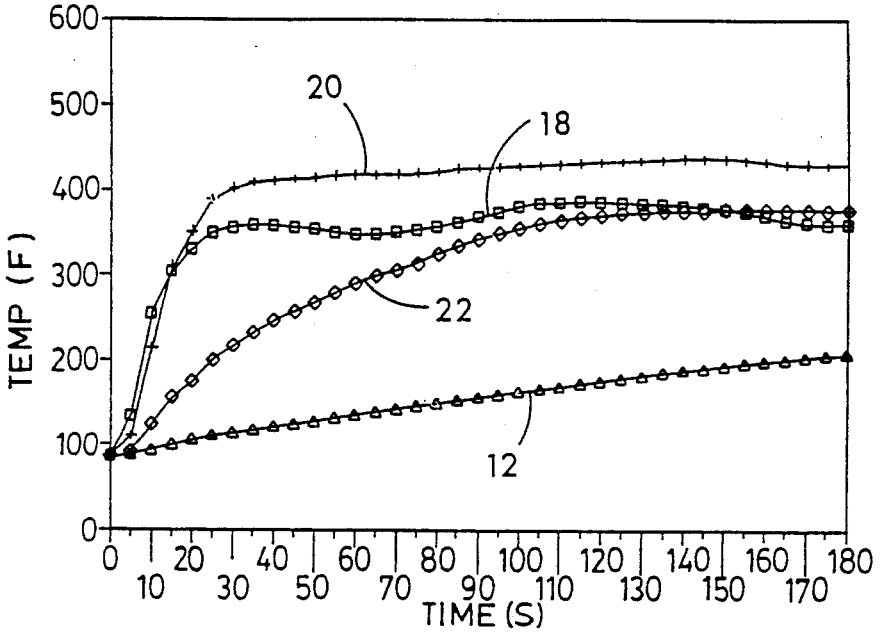
FIG. 8 is a graph showing temperatures reached in four different portions of the susceptor of FIG. 1.

In the embodiments illustrated in FIGS. 1 and 2 little or no metal has been removed from central areas 18 and 30, whereas a substantial fraction of the metal has been removed from the rings 20, 22 and 32, 34 to provide progressive gradations in the resistivity as well as in the amount of light that will be transmitted, i.e. the optical density of the metal film in these areas, progressing from the greatest optical density at the center to the least at the outer edge. In the area surrounding rings 22 and 34 all of the metal coating has been removed. When the susceptors are placed in a microwave oven each ring 20, 22 and 32, 34 produces a different amount of heat when exposed to microwave energy. The heat produced over a period of three minutes in each portion of the susceptor is shown in FIG. 8.

The embodiments of FIGS. 1 and 2 are especially useful for heating various foods that have a tendency to be moist or soggy at the center. To counteract the sogginess, the center portion 18 or 30 heats the fastest, rings 20 and 32 heat at a somewhat slower rate at least initially, and rings 22 and 34 heat even more slowly. The ring 20 or 32 as the case may be, may however reach a higher final temperature than the center area 18 or 30, as shown in FIG. 8.

Refer now to FIGS. 3–6 which illustrate the stages for producing another form of microwave susceptor for heating foods in a microwave oven.

Figure 3:
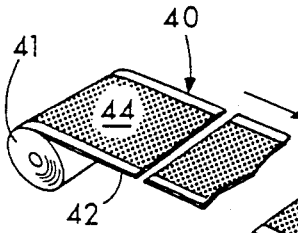
FIG. 3 is a perspective view showing the first stage of forming another product in accordance with the invention.
Figure 4:
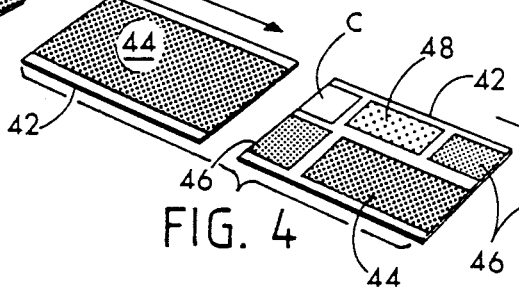
FIG. 4 is a perspective view showing partial demetallization of the sheet illustrated in FIG. 3.

As shown in FIG. 3, a thin flexible strip of plastic film 42 unwound from a supply roll 41 travels during the manufacturing operation from left to right in the figures. The film 42 has already been pre-coated at 44 with a semiconductive layer of aluminum which can be from about 5 Å to about 1200 Å in thickness. The electrical characteristics of the metal film cause it to become hot in a microwave oven. The metal coating 44 as shown in FIG. 4 covers the entire film except, in this case, the extreme edges which were not coated. The coating in this case was accomplished by vapor metallization with aluminum to provide a coating 44 of uniform thickness. Various amounts of metal are removed in different areas of the film as shown in FIG. 4. In this example no metal is removed from the coated area 44 which appears as a dark rectangle in the lower right portion of the cut sheet. A fraction, say 20%, of the metal film is removed from rectangular areas 46 at opposite corners of the sheet which appear medium grey in color and completely uniform throughout, while a still greater amount of metal, say 30%, is removed in the rectangular area 48 which appears to have a grey color of a somewhat lighter shade than the areas 46. In the remaining area which forms a compartment C in the upper left corner all of the metal coating 44 has been removed so that the film 42 appears clear and transparent.

Figure 5:
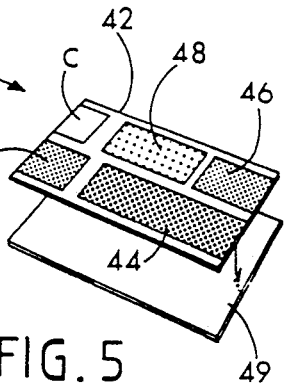
FIG. 5 is a perspective view showing a sheet prepared in FIG. 4 as it is being laminated to a paper backing.
Figure 6:
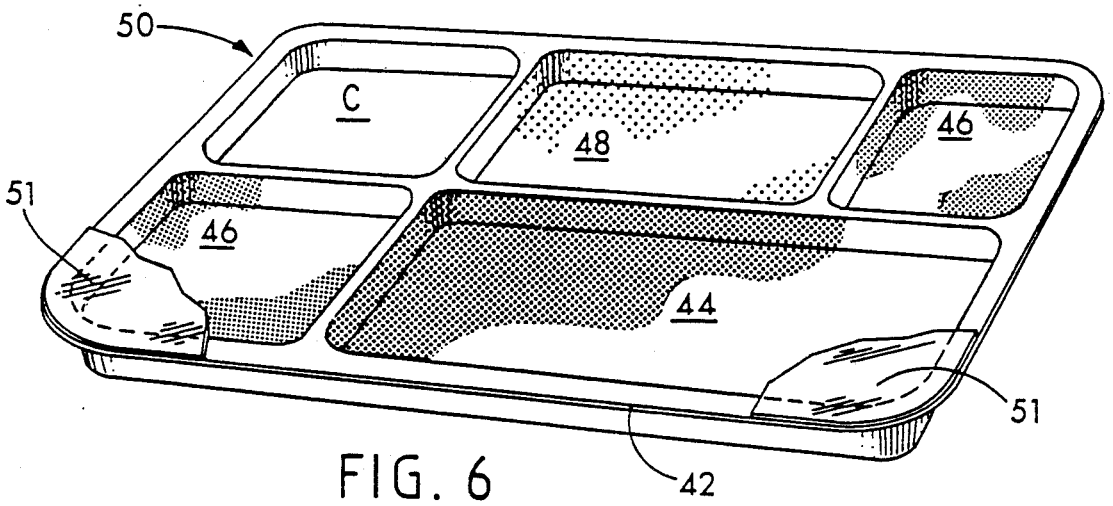
FIG. 6 is a perspective view of a frozen dinner tray prepared from the laminate of FIG. 5 for heating foods in a microwave oven.

In FIG. 5 the differentially coated sheet 42 is shown being laminated to a sheet of paperboard 49 which functions as a support. After the sheets 42 and 49 have been laminated together by means of an adhesive, they are pressed into the shape shown in FIG. 6 to provide a food storage and serving tray having five compartments for various foods requiring heating to different degrees in a microwave oven. The area 44 which contains the most metal will heat most rapidly, the compartments containing metal coatings designated 46 will heat to a moderate degree. The compartment containing the coated area 48 will produce even less heat. No heat will be produced in the compartment C which can be used for a food that requires no surface heating. In this way a package is provided which includes a number of different areas adapted to heat differentially. The heat is provided by means of a susceptor having gradations in resistivity and optical density to produce different amounts of heat in different areas as required. This results from the several gradations of metal removed by pattern demetalization of the metallized sheet 42. After the food has been placed in the tray 50, a cover 51 (only a small portion of which is shown) can be bonded over the top of the tray to provide a package for storing and shipping a complete meal that is to be heated to different degrees in different areas when placed in a microwave oven. Thus the tray 50 provides a metal film with a plurality of optical densities as required for each of several different foods requiring different amounts of heat. The temperature reached by each food varies with the optical density of the metal film that remains.

Figure 7:
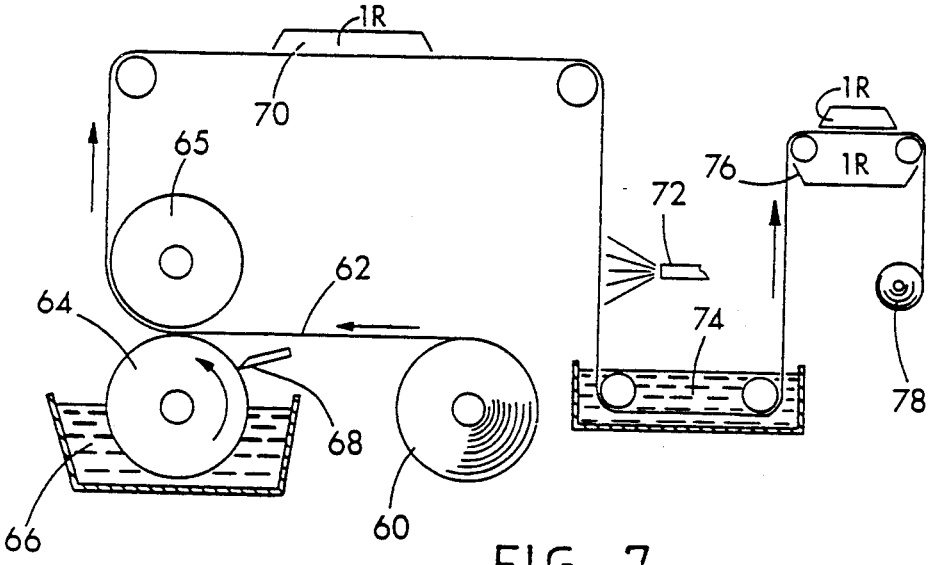
FIG. 7 is a schematic diagram illustrating one form of demetallization in accordance with the invention.

Refer now to FIG. 7 which illustrates a method employed for producing coated sheet material in accordance with one form of the present invention. As shown in the figure, a one-half mil strip of polyester film is unrolled from the supply roll 60, travels over a steel gravure roll 64 which contains a multiplicity of minute cavities or cells 64*a* that are filled as the roll 64 rotates with a caustic solution in bath 66. Excess solution is removed by a doctor blade 68. A suitable caustic solution is:

| | |
|---|---|
| NaOH | 32 lb |
| $H_2O$ | 186 lb |
| Xanthan gum (Kelzan S ®) | 1,000 ml |

Figure 7A:
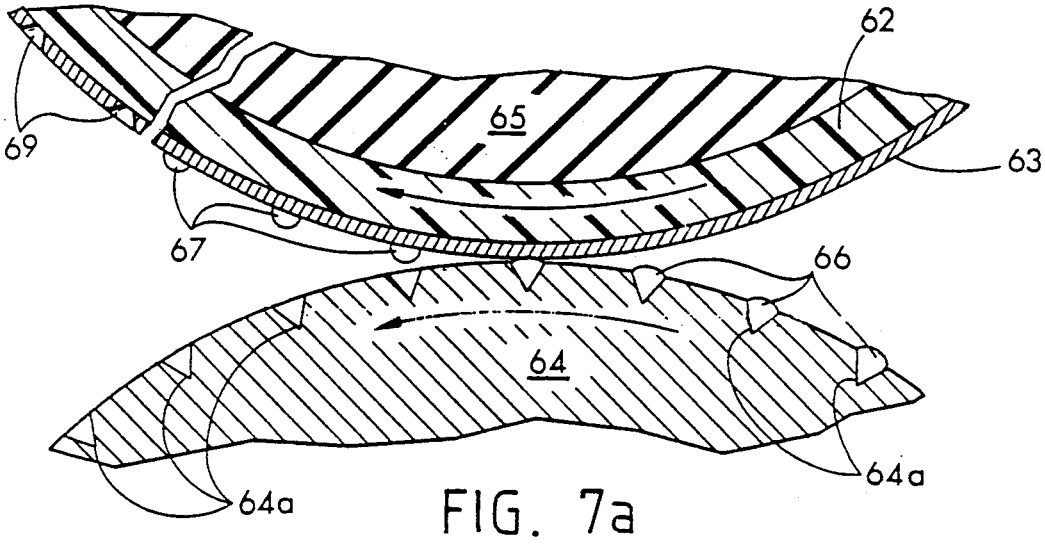
FIG. 7A is a greatly enlarged vertical sectional view showing the transfer of etchant from a carrier to a metal coated sheet.

In this way the caustic 66 contained in the cells 64*a* contacts the metal coating 63 supported by the plastic film 62 and transfers to the metal film (shown in FIG. 7A) as minute spaced apart droplets 67, e.g. 40 microns across, adhered to the metal coating 63 by capillary attraction. If desired, a flexographic roll can be used in place of the gravure roll.

In the alternative, the backing 62 can comprise a smooth paper or a paper having a smooth surface coating to which the metal film 63 is applied by vapor metallization under vacuum. The plastic film and metal coating 63 are forced into contact with the steel gravure roll 64 by means of a driven rubber backing roll 65. From the gravure roll 64 the film passes over idler rolls beneath an infrared heater 70 which warms the caustic slightly to assist in removing a portion of the metal film 63. The etchant remains on the film 63 for a few seconds, e.g. about 4 seconds. Next, the caustic solution and dissolved metal are removed by means of a water spray 72 and water bath 74. After passing through the water bath 74 which is filled with fresh circulating water, the film passes over additional idler rolls between a pair of infrared heaters 76 which remove excess moisture. The metal film 63 at this stage then contains a multiplicity of etched and patterned openings 69. The finished coated film is then wound into a roll 78.

Thus, in accordance with the present invention the etchant (or in an alternative form of the invention a protective varnish) is carried in machined or etched cells of a cylinder with varying degrees of etch in different areas. The degree of etching or machining will remove different amounts of metal from the roll. A deeper etching removes more metal and allows the resulting cells to carry more of the caustic solution onto the metal coated film.

The thin metal film 63 is removed in this way by halftone printing which reduces the continuous tone coating of the original uniformly coated metal film 63 by the application of a pattern of variably sized dots of caustic solution 66 on uniform fixed centers. The gravure roll 64 is prepared in the manner of a printing roll to produce cells 64*a* of a desired size to produce caustic droplets of varying sizes depending upon the size of the cells 64*a*. When the cells 64*a* are increased in size more of the metal film 63 will be removed and consequently, less heat will usually be produced by the resulting halftone film. The cell size and the droplet values are in this way chosen and distributed uniformly by halftone printing accomplished with a gravure roll 64. While not critical, the halftone etching of metal from roll 64 in this case provides cells 64*a* arranged in an elongated Helio pattern with 250 lines of cells per inch. The cells 64*a* can be arranged in any desired pattern but typically have a count of about 25 to 500, and preferably 60 to 300, lines of cells per lineal inch. The cells 64*a* in the ring 20 can have a cross-section of about 38 microns and those in the ring 22 can be about 50 microns across.

In order to make sure that most of the caustic 66 exits the cells 64*a*, the surface tension of the sheet 62 can be adjusted, for example by exposing it to a corona discharge. The sheet 62 may originally have a surface tension of about 40 dynes/cm. This can be raised by corona treatment to at least about 50 dynes/cm and preferably to 60 dynes/cm or above. In this way the caustic 66 is transferred to the metal film 63 by capillary attraction. In one product of the type shown in FIG. 1, the ring 20 consisted of 17–18% open cell area and the ring 22 consisted of about 22% open cell area to produce openings 69.

In an alternative process, the continuous metal coating 63 is partially covered with a protective varnish applied in a pattern by halftone printing, for example as a pattern of dots or as a grid which covers the metal coating 63. After the varnish is dry, the entire surface is coated with caustic which dissolves the metal exposed between the varnish patterned areas.

Refer now to FIG. 8 which illustrates in graph form the temperatures reached in a 650 watt Litton microwave oven with no heat absorbing load. It will be seen that the center area in which little or no metal is removed heats most rapidly but that after 20 seconds the inner circle 20 reaches a higher temperature. The outer circle 22 becomes heated much more slowly but eventually reaches a temperature higher than the center area 18. The area 12 with no metal is the slowest in heating.

The optical density, light transmission and ohms per square for the three coated areas is given in the following table:

| Film Area (FIG. 1) | Optical Density (Tobias Densitometer, Model TBX | Percent Light Transmission (Tobias Assoc. Conversion Chart; Ivyland, PA) | Ohms/Square |
|---|---|---|---|
| 18 | .23 | | 217 |
| 20 | .18 | | 1,666 |
| 22 | .11 | | over 10,000 |

Figure 9:
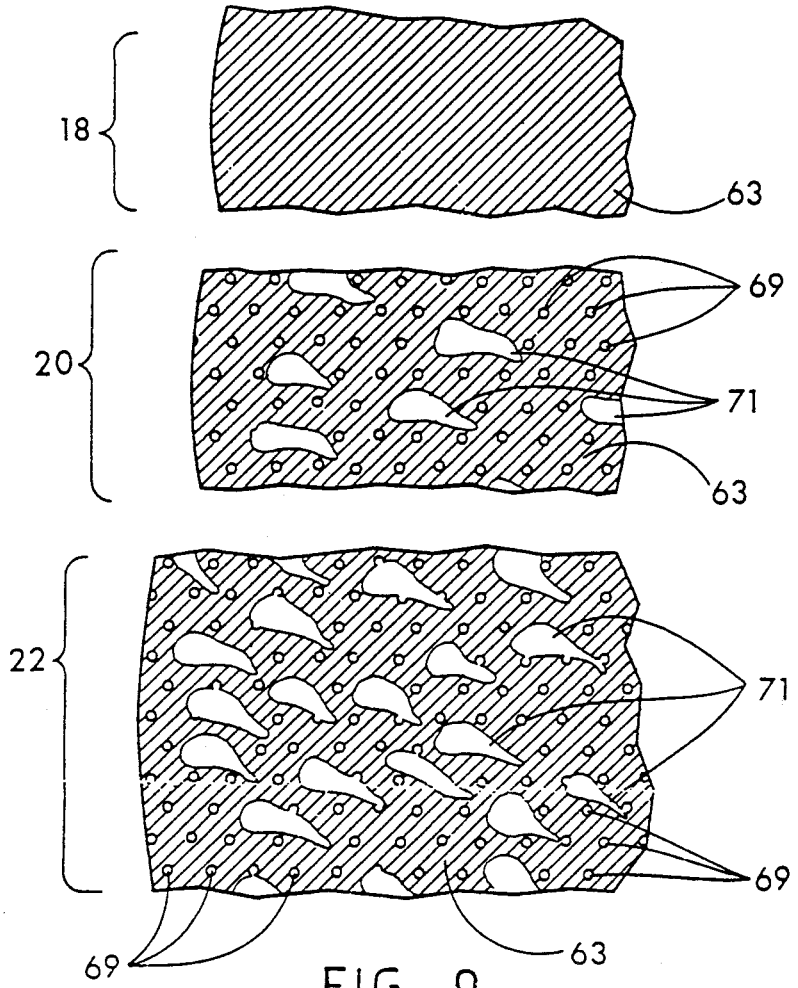
FIG. 9 is a diagrammatic microscopic plan view of the demetallized product of FIG. 1 at a magnification of approximately 60X.

As shown in FIG. 9, the metal coating 63 contains a hexagonal pattern of openings 69 each about 40 microns across arranged in an elongated helio pattern, in this case at uniformly spaced intervals. The rings 20 and 22 also contain regions 71 of microscopic size in which the metal coating 63 is either relatively thin or completely removed. As can be seen, the regions 71 are larger and more numerous in the ring 22 than they are in the ring 20, giving ring 22 a lower optical density than ring 20 or center area 18.

From the foregoing description it can be seen that in accordance with the present invention a thin metal film is partially removed by contacting the film with the surface of a roll such as a gravure roll or, if desired, a flexigraphic roll or other roll suitable for halftone printing which contains a multiplicity of microscopic cells containing varnish or a caustic etchant. The number of microscopic cells and the volume of each is varied so that more metal is removed in some areas, as area 22, than in other areas such as areas 18 and 20 of the sheet to provide patterned gradations in the amount of metal remaining on the metallized sheet. The resulting product produces graduated microwave heating and can also be used for decorative purposes.

In decorative packaging the metal coating is applied, for example, to cellophane or other transparent packaging sheet material with various coating thicknesses to provide gradations in the amount of metal remaining in the coating from one area to another. The invention can also be used for security purposes, for example as an insert making up a portion of a credit card as well as in passports, bills and currency. It can also be used as a radar absorbing material. Other non-food applications of the invention include box overwraps for clothing, lingerie, cosmetics, candies and snack foods, in which case the metallization will usually consist of a bright, highly reflective metallized coating.

The invention can be used for heating a variety of foods such as pizza, fruit pies, meat pies, breads, TV dinners, french fries, as well as batter covered foods. When used for heating, the flexible plastic backing is preferably laminated to a stiff or stable support such as paper or paperboard.

Many variations of the present invention within the scope of the appended claims will be apparent to those skilled in the art once the principles described herein are understood.

What is claimed is:

1. A susceptor for microwave heating comprising, a nonconductive sheet backing as a supporting material, an electrically conductive or semi conductive coating substance as a layer on the backing sheet to produce heat when exposed to microwave energy in a microwave oven, said coating substances having gradations in the amount of said coating substance from one area thereof to another to provide differences in the amount of heat produced in different areas thereof.

2. The susceptor of claim 1 wherein the gradations in the amount of said substance are arranged such that the greatest amount is in a center portion of said coating substance and declining amounts of said substance are present in areas proceeding toward a peripheral portion of the susceptor.

3. The susceptor of claim 1 wherein the coating substance comprises a metal.

4. A susceptor for microwave heating comprising a non-conductive backing of flexible sheet material, an electrically conductive or semiconductive metal film thereon having a selected resistivity in one area and a different resistivity in a second area.

5. The susceptor of claim 4 for microwave heating wherein a portion of the metal coating is etched to provide a pattern of variably sized recesses of removed metal, said recesses of removed metal being located on uniform fixed centers with different amounts of metal being removed in some recesses than in others to provide a pattern of recesses of larger and smaller sizes.

6. The product of claim 5 wherein the metal is removed in a halftone pattern composed of a series of rows and columns having predetermined centers.

7. The product of claim 6 wherein the recesses have a diameter of about 10 microns to about 500 microns, with about 60 to about 500 cells per linear inch in each row.

8. A decorative package formed from a metal coated sheet prepared by providing a conductive substrate having a thin metal film thereon, removing different amounts of the metal film from different portions of the substrate to provide differences in the amount of metal film remaining in the different portions thereof whereby the different portions of the metal film exhibit differences in optical density.

9. A metal coated product comprising a nonconductive backing of flexible sheet material, a metal film thereon having a selected resistivity in one area and a different resistivity in a second area.

10. The product of claim 9 for microwave heating wherein the portion of the metal coating is etched to provide a pattern of variably sized regions of removed metal, said regions being located at predetermined centers with more metal being removed in some regions than in others.

11. The product of claim 10 wherein the removed metal is arranged in a halftone pattern as a series of rows and columns having fixed centers.

12. The product of claim 11 wherein the openings have a diameter of about 10 micros to about 500 microns, with about 60 to about 250 cells per linear inch in each row.

13. The metal coated product of claim 9 wherein said metal coated product is formed into a decorative package having at least one compartment therein to hold an article and the differences in resistivity of the metal film in different areas produce a decorative effect.

14. The susceptor of claim 2 wherein said coating substance includes at least one peripheral ring surrounding the central portion and said ring contains a reduced amount of the coating substance per unit area compared with the central portion.

15. The susceptor of claim 14 wherein a plurality of said rings are provided, each said ring having a reduced amount of said coating substance per unit area compared with an adjacent area centrally thereof.

16. A susceptor for microwave heating comprising, a non-conductive backing of flexible sheet material, an electrically conductive or semiconductor metal film thereon having a selected optical density in one area and a different optical density in a second area.

17. A metal coated product comprising, a nonconductive backing of flexible sheet material, a metal film thereon having a selected optical density in one area and a different optical density in a second area.

18. The susceptor of claim 16 for microwave heating wherein a portion of the metal coating is etched to provide a pattern of variably sized recesses of removed metal, said recesses of removed metal being located on fixed centers with different amounts of metal being removed in some recesses than in others to provide a pattern of recesses of larger and smaller sizes.

19. The product of claim 18 wherein the metal is removed in a halftone pattern composed of a series of rows and columns on uniform fixed centers.

20. The product of claim 17 for microwave heating wherein a portion of the metal coating is etched to provide a pattern of variably sized regions of removed metal, said regions being located on predetermined centers with more metal being removed in some regions than in others.

21. The product of claim 20 wherein the removed metal is arranged in a halftone pattern as a series of rows and columns on predetermined centers.

22. The product of claim 21 wherein the openings have a diameter of about 10 micros to about 500 microns, with about 60 to about 250 cells per linear inch in each row.

23. The metal coated product of claim 17 wherein said metal coated product is formed into a decorative package having at least one compartment therein to hold an article and the differences in optical density of the metal film in different areas produce a decorative effect.

24. The susceptor of claim 16 wherein said metal film includes at least one peripheral ring surrounding a central portion and said ring contains a reduced amount of the metal per unit area compared with the central portion.

25. The susceptor of claim 24 wherein a plurality of said rings are provided, each said ring having a reduced amount of said metal per unit area compared with an adjacent area centrally thereof.

26. A process for producing a microwave susceptor having at least two regions of microwave active metal material, said method including the steps of, providing a substrate having a microwave active film of metallic material thereon, and selectively removing a portion of the microwave active film from the substrate in at least each of first and second areas thereof, said step of removing a portion of the microwave active film from the first area being conducted in a manner leaving a coating of microwave active metallic material therein having a first resistivity and said step of removing a portion of the microwave active film from the second area being conducted in a manner leaving a coating of microwave active metallic material therein having a second resistivity, the second resistivity being different from the first resistivity.

27. A process according to claim 26 wherein said step of selectively removing a portion of the microwave active film from the substrate in at least each of the first and second areas includes exposing the second area to etchant droplets of a first average size and exposing a second region to etchant droplets of a second average size, the first average size being different from the second average size.

28. A process according to claim 26 wherein said step of selectively removing a portion of the microwave active film from the substrate in at least each of the first and second areas includes applying etchant solution to the microwave active film in the first and second areas, said step of applying etchant to the metal film including applying the etchant to a roller and transferring the etchant from the roller to the microwave active film by capillary attraction.

29. A process according to claim 28 including a step of washing the metal film after said step of transferring the etchant to the metal film.

30. A process according to claim 28 including steps of irradiating the film with infrared radiation after the etchant has been applied thereto and washing the film after the step of irradiating.

31. A process according to claim 26 wherein said step of selectively removing a portion of the film from the substrtate in at least each of the first and second areas includes applying different amount of an etchant to each of the first and second areas.

32. A susceptor for microwave heating, said susceptor comprising, a backing and a microwave active metal coating supported on said backing, said microwave active metal coating defining at least first and second areas of microwave active metal, said first area of microwave active metal having a first resistivity and said second area of microwave active metal having a second resistivity, said second resistivity being different from the first resistivity.

33. A susceptor according to claim 32 wherein said first area of metal coating includes therein a plurality of recesses of a first average size and said second area of metal coating includes therein a plurality of recesses of a second average size, said second average size being different from said first average size.

34. A susceptor according to claim 32 wherein said first area of microwave active metal comprises a halftone pattern of rows and columns of recesses, on predetermined centers, having a first average size, and said second area of microwave active metal comprises a halftone pattern of rows and columns of recesses, on predetermined centers, having a second average size, said second average size being different from said first average size.

35. A susceptor according to claim 32 wherein said first region of microwave active metal has a circular configuration, and said second region of microwave active metal comprises a ring circumscribing said first region of microwave active metal.

36. A susceptor according to claim 35 wherein said first resistivity is higher than said second resistivity.

37. A process for producing a microwave susceptor having at first and second areas of microwave active metal material, said method including the steps of, providing a substrate having a microwave active film of metallic material thereon, and selectively removing a portion of the microwave active film from the substrate in at least said first area thereof, said step of removing a portion of the microwave active film from the first area being conducted in a manner which leaves a coating of microwave active metallic material therein having a first resistivity, said process being conducted in a manner leaving a coating of microwave active metallic material in said second area that has a second resistivity which is different from the resistivity of said first area.

38. The process of claim 37 wherein said step of selectively removing a portion of the microwave active film from said first area includes exposing the first area to etchant droplets for removing a portion of the metallic film contacted by the droplets.

39. The process according to claim 37 wherein said step of removing a portion of the microwave active film from the substrate in at least said first area includes applying etchant solution to the microwave active film in said first area, said step of applying etchant to the metal film including applying the etchant to a roller and transferring the etchant from the roller to the microwave active film by capillary attraction.

40. The process according to claim 39 including a step of washing the metal film after said step of transferring the etchant to the metal film.

* * * * *

US005059279A

REEXAMINATION CERTIFICATE (2448th)

United States Patent [19]

Wilson

[11] *B1 5,059,279

[45] Certificate Issued Jan. 3, 1995

[54] SUSCEPTOR FOR MICROWAVE HEATING

[75] Inventor: David Wilson, Mississauga, Canada

[73] Assignee: Golden Valley Microwave Foods, Inc., Edina, Minn.

Reexamination Request:
No. 90/002,902, Dec. 7, 1992

Reexamination Certificate for:

| | |
|---|---|
| Patent No.: | **5,059,279** |
| Issued: | **Oct. 22, 1991** |
| Appl. No.: | **529,229** |
| Filed: | **May 25, 1990** |

Related U.S. Application Data

[63] Continuation of Ser. No. 369,193, Jun. 21, 1989, Pat. No. 4,959,120.

[*] Notice: The portion of the term of this patent subsequent to Sep. 25, 2007 has been disclaimed.

[51] Int. Cl.[6] ..... B44C 1/22; C23F 1/02

[52] U.S. Cl. ..... 156/651; 156/634; 156/659.1; 219/10.55 E; 383/116; 428/209

[58] Field of Search ..... 156/629, 630, 633, 634, 156/643, 651, 656, 659.1, 660, 661.1, 664, 665; 428/195, 209; 219/10.43, 10.55 E, 10.55 M, 10.55 R; 383/116

[56] References Cited

U.S. PATENT DOCUMENTS

| | | | |
|---|---|---|---|
| 3,616,049 | 10/1971 | Moore et al. | 156/345 |
| 4,242,378 | 12/1980 | Arai | 427/264 |
| 4,676,857 | 6/1987 | Scharr et al. | 156/233 |
| 4,915,780 | 4/1990 | Beckett | 156/661.1 |

FOREIGN PATENT DOCUMENTS 2202118 9/1988 United Kingdom .

*Primary Examiner*—William A. Powell

[57] ABSTRACT

A selectively demetallized metal film is provided in which the metal film has different amounts of metal removed in different areas to provide a film having a graduated optical density from one area to another. The amount of metal present in the film can vary gradually and continuously or in stages resulting in a series of bands or patches. Each portion of the film appears uniform, homogeneous and uninterrupted to the unaided eye. The product is produced by providing a substrate such as plastic film having a thin semiconductive metal film coated thereon. Different amounts of the metal are removed from the film in different areas, preferably by exposing the metal film in different areas to different amounts of an etchant which can be provided in the form of minute droplets of one size in one area and of a different size in a different area. The etchant can be applied by halftone printing as variably sized dots on uniformly fixed centers with larger dots of etchant applied in some areas than in others to remove a greater amount of the metal.

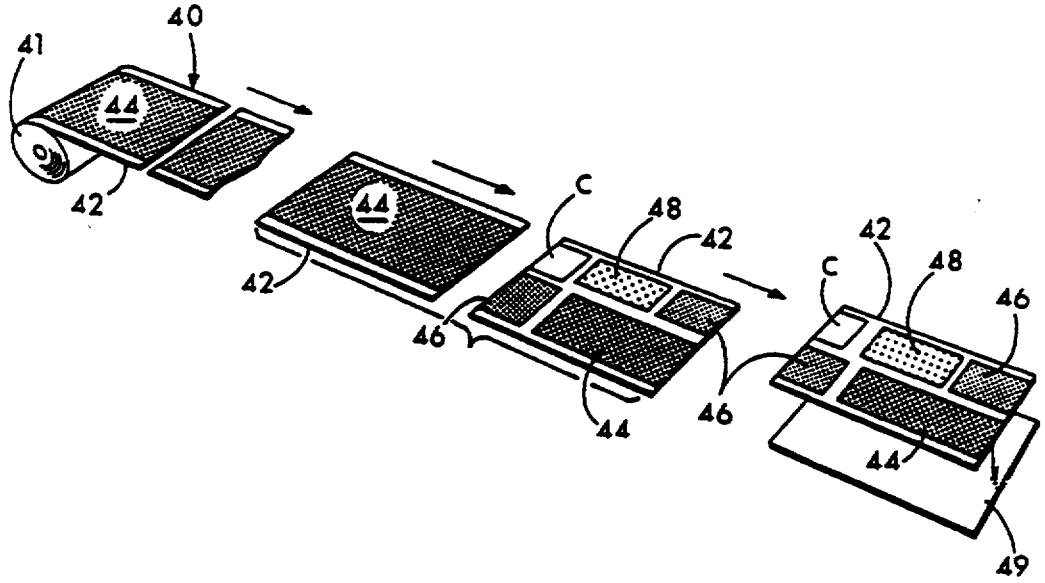

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 2, 5, 8–11, 14, 16, 18, 20, 21, 24, 27, 28, 31–35 and 37–39 are cancelled.

Claims 1, 3, 4, 6, 12, 13, 15, 17, 19, 22, 23, 25, 26, 29, 30, 36 and 40 are determined to be patentable as amended.

Claim 7, dependent on an amended claim, is determined to be patentable.

New claims 41–54 are added and determined to be patentable.

1. A susceptor for microwave heating comprising, a nonconductive sheet backing as a supporting material, an electrically conductive or semi conductive coating substance as a layer on the backing sheet to produce heat when exposed to microwave energy in a microwave oven, said coating substances having gradations in the amount of said coating substance [from one area thereof to another] *per unit area in at least first and second areas* to provide differences in the amount of heat produced in [different areas thereof] *said first and second areas, at least one of said first and second areas having at least first and second portions, said first portion having a first thickness of said coating substance and said second portion having a second thickness of said coating substance different from said first thickness.*

3. The susceptor of claim [1] *41* wherein the coating substance comprises a metal.

4. A susceptor for microwave heating comprising a non-conductive backing of flexible sheet material, an electrically conductive or semiconductive metal film thereon having a selected resistivity in [one] *a first* area and a different resistivity in a second area, *said first and second areas having different amounts of said metal film per unit area, at least one of said first and second areas having at least first and second portions, said first portion having a first thickness of said metal film and said second portion having a second thickness of said metal film.*

6. The product of claim [5] *42* wherein the metal is removed in a halftone pattern composed of a series of rows and columns having predetermined centers.

12. The product of claim [11] *43* wherein the openings have a diameter of about 10 microns to about 500 microns, with about 60 to about 250 cells per linear inch in each row.

13. The metal coated product of claim [9] *43* wherein said metal coated product is formed into a decorative package having at least one compartment therein to hold an article and the differences in resistivity of the metal film in different areas produce a decorative effect.

15. The susceptor of claim [14] *41* wherein a plurality of said rings are provided, each said ring having a reduced amount of said coating substance per unit area compared with an adjacent area centrally thereof.

17. A metal coated product comprising, a nonconductive backing of flexible sheet material, a metal film thereon having a selected optical density in [one] *a first* area and a different optical density in a second area, *said first and second areas having different amounts of said metal film per unit area, at least one of said first and second areas having at least first and second portions, said first portion having a first thickness of said metal film and said second portion having a second thickness of said metal film.*

19. The product of claim [18] *44* wherein the metal is removed in a halftone pattern composed of a series of rows and columns of uniform fixed centers.

22. The product of claim [21] *46* wherein the openings have a diameter of about 10 microns to about 500 microns, with about 60 to about 250 cells per linear inch in each row.

23. The metal coated product of claim [17] *46* wherein said metal coated product is formed into a decorative package having at least one compartment therein to hold an article and the differences in optical density of the metal film in different areas produce a decorative effect.

25. The susceptor of claim [24] *45* wherein a plurality of said rings are provided, each said ring having a reduced amount of said metal per unit area compared with an adjacent area centrally thereof.

26. A process for producing a microwave susceptor having at least two regions of microwave active metal material, said method including the steps of, providing a substrate having a microwave active film of metallic material thereon, and selectively removing a portion of the microwave active film from the substrate in at least each of first and second areas thereof, said step of removing a portion of the microwave active film from the first area being conducted in a manner leaving a coating of microwave active metallic material therein having a first resistivity and said step of removing a portion of the microwave active film from the second area being conducted in a manner leaving a coating of microwave active metallic material therein having a second resistivity, the second resistivity being different from the first resistivity, *said first and second areas having different amounts of said microwave active film per unit area, at least one of said first and second areas having at least first and second portions, said first portion having a first thickness of said microwave active film and said second portion having a second thickness of said microwave active film.*

29. A process according to claim [28] *48* including a step of washing the metal film after said step of transferring the etchant to the metal film.

30. A process according to claim [28] *48* including steps of irradiating the film with infrared radiation after the etchant has been applied thereto and washing the film after the step of irradiating.

36. A susceptor according to claim [35] *52* wherein said first resistivity is higher than said second resistivity.

40. The process according to claim [39] *54* including a step of washing the metal film after said step of transferring the etchant to the metal film.

*41. A susceptor for microwave heating comprising, a nonconductive sheet backing as a supporting material, an*

*electrically conductive or semi conductive coating substance as a layer on the backing sheet to produce heat when exposed to microwave energy in a microwave oven, said coating substances having gradations in the amount of said coating substance from one area thereof to another to provide differences in the amount of heat produced in different areas thereof, wherein the gradations in the amount of said substance are arranged such that the greater amount is in a center portion of said coating substance and declining amounts of said substance are present in areas proceeding toward a peripheral portion of the susceptor, and wherein said coating substance includes at least one peripheral ring surrounding the central portion and said ring contains a reduced amount of the coating substance per unit area compared with the central portion.*

*42. A susceptor for microwave heating comprising a non-conductive backing of flexible sheet material, an electrically conductive or semiconductive metal film thereon having a selected resistivity in one area and a different resistivity in a second area, wherein a portion of the metal coating is etched to provide a pattern of variably sized recesses of removed metal, said recesses of removed metal being located on uniform fixed centers with different amounts of metal being removed in some recesses than in others to provide a pattern of recesses of larger and smaller sizes.*

*43. A metal coated product comprising a nonconductive backing of flexible sheet material, a metal film thereon having a selected resistivity in one area and a different resistivity in a second area, wherein the portion of the metal coating is etched to provide a pattern of variably sized regions of removed metal, said regions being located at predetermined centers with more metal being removed in some regions than in others, and wherein the removed metal is arranged in a halftone pattern as a series of rows and columns having fixed centers.*

*44. A susceptor for microwave heating comprising, a non-conductive backing of flexible sheet material, an electrically conductive or semiconductive metal film thereon having a selected optical density in one area and a different optical density in a second area, wherein a portion of the metal coating is etched to provide a pattern of variably sized recesses of removed metal, said recesses of removed metal being located on fixed centers with different amounts of metal being removed in some recesses than in others to provide a pattern of recesses of larger and smaller sizes.*

*45. A susceptor for microwave heating comprising, a non-conductive backing of flexible sheet material, an electrically conductive or semiconductor metal film thereon having a selected optical density in one area and a different optical density in a second area, wherein said metal film includes at least one peripheral ring surrounding a central portion and said ring contains a reduced amount of the metal per unit area compared with the central portion.*

*46. A metal coated product comprising, a nonconductive backing of flexible sheet material, a metal film thereon having a selected optical density in one area and a different optical density in a second area, wherein a portion of the metal coating is etched to provide a pattern of variably sized regions of removed metal, said regions being located on predetermined centers with more metal being removed in some regions than in others wherein the removed metal is arranged in a halftone pattern as a series of rows and columns on predetermined centers.*

*47. A process for producing a microwave susceptor having at least two regions of microwave active metal material, said method including the steps of, providing a substrate having a microwave active film of metallic material thereon, and selectively removing a portion of the microwave active film from the substrate in at least each of first and second areas thereof, said step of removing a portion of the microwave active film from the first area being conducted in a manner leaving a coating of microwave active metallic material therein having a first resistivity, said step of removing a portion of the microwave active film from the second area being conducted in a manner leaving a coating of microwave active metallic material therein having a second resistivity, the second resistivity being different from the first resistivity, wherein said step of selectively removing a portion of the microwave active film from the substrate in at least each of the first and second areas includes exposing the second area to etchant droplets of a first average size and exposing a second region to etchant droplets of a second average size, the first average size being different from the second average size.*

*48. A process for producing a microwave susceptor having at least two regions of microwave active metal material, said method including the steps of, providing a substrate having a microwave active film of metallic material thereon, and selectively removing a portion of the microwave active film from the substrate in at least each of first and second areas thereof, said step of removing a portion of the microwave active film from the first area being conducted in a manner leaving a coating of microwave active metallic material therein having a first resistivity and said step of removing a portion of the microwave active film from the second area being conducted in a manner leaving a coating of microwave active metallic material therein having a second resistivity, the second resistivity being different from the first resistivity, wherein said step of selectively removing a portion of the microwave active film from the substrate in at least each of the frist and second areas includes applying etchant solution to the microwave active film in the first and second areas, said step of applying etchant to the metal film including applying the etchant to a roller and transferring the etchant from the roller to the microwave active film by capillary attraction.*

*49. A process for producing a microwave susceptor having at least two regions of microwave active metal material, said method including the steps of, providing a substrate having a microwave active film of metallic material thereon, and selectively removing a portion of the microwave active film from the substrate in at least each of first and second areas thereof, said step of removing a portion of the microwave active film from the first area being conducted in a manner leaving a coating of microwave active metallic material therein having a first resistivity and said step of removing a portion of the microwave active film from the second area being conducted in a manner leaving a coating of microwave active metallic material therein having a second resistivity, the second resistivity being different from the first resistivity, wherein said step of selectively removing a portion of the film from the substrate in at least each of the first and second areas includes applying different amount of an etchant to each of the first and second areas.*

*50. A susceptor for microwave heating, said susceptor comprising, a backing and a microwave active metal coating supported on said backing, said microwave active metal coating defining at least first and second areas of microwave active metal, said first area of microwave active metal having a first resistivity and said second area of microwave active metal having a second resistivity, said second resistivity being different from the first resistivity, wherein said first area of metal coating includes therein a plurality of*

*recesses of a first average size and said second area of metal coating includes therein a plurality of recesses of a second average size, said second average size being different from said first average size.*

*51. A susceptor for microwave heating, said susceptor comprising, a backing and a microwave active metal coating supported on said backing, said microwave active metal coating defining at least first and second areas of microwave active metal, said first area of microwave active metal having a first resistivity and said second area of microwave active metal having a second resistivity, said second resistivity being different from the first resistivity, wherein said first area of microwave active metal comprises a halftone pattern of rows and columns of recesses, on predetermined centers, having a first average size, and said second area of microwave active metal comprises a halftone pattern of rows and columns of recesses, on predetermined centers, having a second average size, said second average size being different from said first average size.*

*52. A susceptor for microwave heating, said susceptor comprising, a backing and a microwave active metal coating supported on said backing, said microwave active metal coating defining at least first and second areas of microwave active metal, said first area of microwave active metal having a first resistivity and said second area of microwave active metal having a second resistivity, said second resistivity being different from the first resistivity, wherein said first region of microwave active metal has a circular configuration, and said second region of microwave active metal comprises a ring circumscribing said first region of microwave active metal.*

*53. A process for producing a microwave susceptor having at least first and second areas of microwave active metal material, said method including the steps of, providing a substrate having a microwave active film of metallic material thereon, and selectively removing a portion of the microwave active film from the substrate in at least said first area thereof, said step of removing a portion of the microwave active film from the first area being conducted in a manner which leaves a coating of microwave active metallic material therein having a first resistivity, said process being conducted in a manner leaving a coating of microwave active metallic material in said second area that has a second resistivity which is different from the resistivity of said first area, wherein said step of selectively removing a portion of the microwave active film from said first area includes exposing the first area to etchant droplets for removing a portion of the metallic film contacted by the droplets.*

*54. A process for producing a microwave susceptor having at least first and second areas of microwave active metal material, said method including the steps of, providing a substrate having a microwave active film of metallic material thereon, and selectively removing a portion of the microwave active film from the substrate in at least said first area thereof, said step of removing a portion of the microwave active film from the first area being conducted in a manner which leaves a coating of microwave active metallic material therein having a first resistivity, said process being conducted in a manner leaving a coating of microwave active metallic material in said second area that has a second resistivity which is different from the resistivity of said first area, wherein said step of remvoing a portion of the microwave active film from the substrate in at least said first area includes applying etchant solution to the microwave active film in said first area, said step of applying etchant to the metal film including applying the etchant to a roller and transferring the etchant from the roller to the microwave active film by capillary attraction.*

* * * * *